US011883734B2

(12) United States Patent
Kim

(10) Patent No.: US 11,883,734 B2
(45) Date of Patent: Jan. 30, 2024

(54) SNOWBOARD DECK

(71) Applicant: Sangwoo Kim, Jeonju-si (KR)

(72) Inventor: Sangwoo Kim, Jeonju-si (KR)

( * ) Notice: Subject to any disclaimer, the term of this patent is extended or adjusted under 35 U.S.C. 154(b) by 0 days.

(21) Appl. No.: 17/899,945

(22) Filed: Aug. 31, 2022

(65) Prior Publication Data

US 2023/0096671 A1 Mar. 30, 2023

(30) Foreign Application Priority Data

Sep. 24, 2021 (KR) ..... 10-2021-0126753

(51) Int. Cl.
*A63C 10/10* (2012.01)
*A63C 10/12* (2012.01)

(52) U.S. Cl.
CPC ..... *A63C 10/10* (2013.01); *A63C 10/12* (2013.01)

(58) Field of Classification Search
CPC ..... A63C 10/10; A63C 10/12; A63C 5/03; A63C 5/0417; A63C 5/0422; A63C 5/048; A63C 9/0802; A63C 9/086; A63C 10/28; A63C 10/005
See application file for complete search history.

(56) References Cited

U.S. PATENT DOCUMENTS 6,224,086 B1 * 5/2001 Golling ..... A63C 10/10 280/14.22
6,254,111 B1 * 7/2001 Servant ..... A63C 5/03 280/14.22
10,729,968 B2 * 8/2020 Barden ..... A63C 10/12
2003/0042693 A1 * 3/2003 Christiansen ..... A63C 5/031 280/7.14
2003/0151215 A1 * 8/2003 Stief ..... A63C 5/033 280/609
2004/0262884 A1 * 12/2004 Langford ..... B62B 13/02 280/601
2009/0256334 A1 * 10/2009 Handel ..... A63C 10/28 280/612
2010/0025967 A1 * 2/2010 Flaig ..... A63C 10/10 36/114

FOREIGN PATENT DOCUMENTS

AT 11462 U1 11/2010
CA 2774325 A1 * 3/2011 ..... B62B 13/06
DE 2652393 A1 * 5/1978

(Continued)

OTHER PUBLICATIONS

Extended European Search Report for Appl. No. 22196399.4 dated Feb. 21, 2023, 9 pages.

(Continued)

*Primary Examiner* — James A Shriver, II
*Assistant Examiner* — Michael T. Walsh
(74) *Attorney, Agent, or Firm* — Maine Cernota & Curran

(57) ABSTRACT

Disclosed herein is a snowboard deck. The snowboard deck includes a board-shaped deck body on which both boots worn by a snowboard user desiring to enjoy riding in a snowfield are positioned and fixed; a binder hole formed in a hole shape in the deck body and provided with a magnet to fasten and fix the boots worn by the snowboard user with a magnetic force; and the boots provided with metal protrusions connected through the magnetic force from the magnet inserted and fastened into the binder hole.

4 Claims, 7 Drawing Sheets

(56) References Cited

FOREIGN PATENT DOCUMENTS

| | | | | | |
|---|---|---|---|---|---|
| DE | 102017004555 | A1 | * | 11/2018 | |
| EP | 0154310 | A1 | * | 9/1985 | |
| EP | 1338312 | A1 | * | 8/2003 | ..... A63C 5/03 |
| EP | 2913085 | A1 | * | 9/2015 | ..... A43B 1/0054 |
| ES | 2341825 | A1 | * | 6/2010 | ..... A63C 9/0802 |
| FR | 2854081 | A1 | * | 10/2004 | ..... A63C 5/03 |
| JP | 2013503699 | A | * | 2/2013 | |
| JP | 2013503699 | A | | 2/2013 | |
| KR | 20050066988 | A | * | 6/2005 | |
| KR | 1020050066988 | A | | 6/2005 | |
| KR | 20150012637 | A | * | 2/2015 | |
| KR | 1020150012637 | A | | 2/2015 | |

OTHER PUBLICATIONS

Notification of Reasons for Refusal Written Opinion for Patent Appl. No. KR1020210126753 dated Nov. 23, 2021, 16 pages.
Written Decision of Registration for Patent Appl. No. KR1020210126753 dated Feb. 18, 2022, 3 pages.

* cited by examiner

SNOWBOARD DECK

RELATED APPLICATIONS

This application claims priority under the Paris Convention to KR Application No. 10-2021-0126753, filed Sep. 24, 2021. This application is herein incorporated by reference, in its entirety, for all purposes.

FIELD OF THE INVENTION

The present invention relates to a snowboard deck, and more particularly, to a snowboard deck having a deck body including a rounded lower base structure having a predetermined thickness rather than a conventional thin plate shape and configured to directly contact snow, a double-edged edge structure configured to assist together with the rounded lower base structure in changing the direction and braking, and a binder hole through which boots provided with metal protrusions are connected by the magnetic force from a neodymium magnet.

BACKGROUND OF THE INVENTION

Snowboarding has recently become one of the most popular sports among young people because it provides dynamic riding along and allows practice of advanced techniques compared to skiing. In order to enjoy such popular snowboarding, equipment such as a deck, a binder, and boots are required. When viewed from a side, the deck is largely divided into upper and lower parts. In particular, the lower part, which contacts the road surface, is called a base.

In general, the body of a snowboard is made of wood, synthetic resin, or a combination of wood and synthetic resin. Any material, which has its own advantage and disadvantage, is waxed to increase the repulsive force to moisture to enhance riding speed.

Since the deck is flat, and has no separate device to change the travel direction or stop riding, an edge is formed along the periphery of the base. In addition, conventional snowboards are formed such that the base and the edge are flat, and are thus subjected to many limitations in improving braking power, and need to be tuned directly by the user, which is an inconvenience.

Riders are generally positioned on the snowboards with their feet facing across the snowboard's longitudinal axis. Thus, as in skiing, riders wear special boots, which are usually secured to the snowboard by a binding mechanism. That is, the binder is a structure that fixes the deck and boots to interfere with free footwork during downhill riding. Such a fastening structure of the deck and boots is mainly intended to prevent injury.

FIG. 1 is a view illustrating a configuration of a snowboard deck with a conventional binder installed, and FIG. 2 is a view illustrating a configuration of a snowboard deck with a conventional binder of another example installed. As shown in FIGS. 1 and 2, a binder 20 such as a hard binder or a soft binder for fixing a boot according to a type of snowboarding such as alpine and freestyle is installed on a conventional snowboard deck 10. That is, in snowboarding, a secure fastening between the boot and the binder 20 is more important than anything else, and the fastening between the boots and the binders 20 should be easily achieved. However, since conventional binders 20 require adjustment of the length of a plurality of fasteners for fastening and fixing boots, they make it difficult for riders such as beginners, children, or women to easily mount boots.

SUMMARY OF THE INVENTION

Therefore, the present disclosure has been made in view of the above problems, and it is an object of the present disclosure to provide a snowboard deck including a board-shaped deck body on which both boots worn by a snowboard user desiring to enjoy riding in a snowfield are positioned and fixed, a binder hole formed in a hole shape in the deck body and provided with a magnet to fasten and fix the boots worn by the snowboard user with a magnetic force, and the boots provided with metal protrusions connected through the magnetic force from the magnet inserted and fastened into the binder hole, such that the boots provided with metal protrusions are connected by the magnetic force from a neodymium magnet to the binder hole of the deck body having a rounded lower base structure having a predetermined thickness rather than a conventional thin plate shape and configured to directly contact snow, a double-edged edge structure configured to assist together with the rounded lower base structure in changing the direction and braking, and the risk of injury is minimized by separation of the deck body and the boots when the user falls down during riding.

It is another object of the present disclosure to provide a snowboard deck further improving user convenience and efficiency by enabling attachment, detachment and fixing of the boots and the deck by the magnetic force in the binder hole such that, unlike the conventional binder, the boots can be fastened easily without precise adjustment, and even beginners, children, or women can easily attach and fix the boots.

It is another object of the present disclosure to provide a snowboard deck constructed in a structure in which the length of the deck board is shorter than that of the conventional snowboard, and binding fastening is achieved by magnetic force, and the protruding edge is formed spaced apart from the base of the deck, such that existing hard boots can be replaced with soft ones, beginners or children can enjoy riding easily, and the shortcomings of the existing snowboard, which often causes injury due to the inability to separate the deck and boots, can be overcome when the user falls during riding, while providing extreme downhill features and easy turning and braking.

In accordance with the present disclosure, the above and other objects can be accomplished by the provision of a snowboard deck including a board-shaped deck body on which both boots worn by a snowboard user desiring to enjoy riding in a snowfield are positioned and fixed; a binder hole formed in a hole shape in the deck body and provided with a magnet to fasten and fix the boots worn by the snowboard user with a magnetic force; and the boots provided with metal protrusions connected through the magnetic force from the magnet inserted and fastened into the binder hole.

Preferably, the deck body may include a rounded lower base having a predetermined thickness rather than a thin plate shape; and an edge formed at both sides of the rounded lower base corresponding to a surface that directly contacts the snow. The edge may protrude while being spaced apart from the body on which the rounded lower base is formed.

More preferably, the edge may be formed to protrude while being spaced apart from the body of the rounded lower base to facilitate direction change and braking of the deck body.

Preferably, the binder hole may include a plurality of binder holes formed in a hole shape in the deck body to be fastened and fixed to the corresponding metal protrusions of the boots worn by the snowboard user by the magnetic force.

More preferably, the binder hole may be installed in the deck body such that five binder holes may be disposed per boot to correspond to an arrangement of the metal protrusions of the boots.

More preferably, the magnet may include a neodymium magnet firmly fastened to the metal protrusions formed on the boots by the magnetic force.

More preferably, the boots may include the metal protrusions connected by the magnetic force of the magnet inserted and fastened to the binder holes. The metal protrusions are individually mounted on the boots like spikes or integrally attached to soles of the boots.

More preferably, in the snowboard deck, the boots worn by the snowboard user are fastened and fixed to the binder hole installed in the deck body by the magnetic force, such that a risk of injury caused by failure of separation between the deck and the boots is minimized when the user falls.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Hereinafter, preferred embodiments will be described in detail with reference to the accompanying drawings such that a person of ordinary skill in the art to which this disclosure pertains may easily implement the embodiments. In describing the preferred embodiments of the present disclosure in detail, a detailed description of known functions and configurations incorporated herein will be omitted to avoid obscuring the subject matter of the present disclosure. Wherever possible, the same reference numbers will be used throughout the drawings to refer to parts that have similar functions and operations.

Throughout the specification, stating that a part is "connected" to another part includes not only the case of being "directly connected" but also the case of being "electrically connected" to another device interposed therebetween. In addition, when a part "includes" or "comprises" a component, the part may further include other components, and such other components are not excluded unless there is a particular description contrary thereto.

Figure 1:
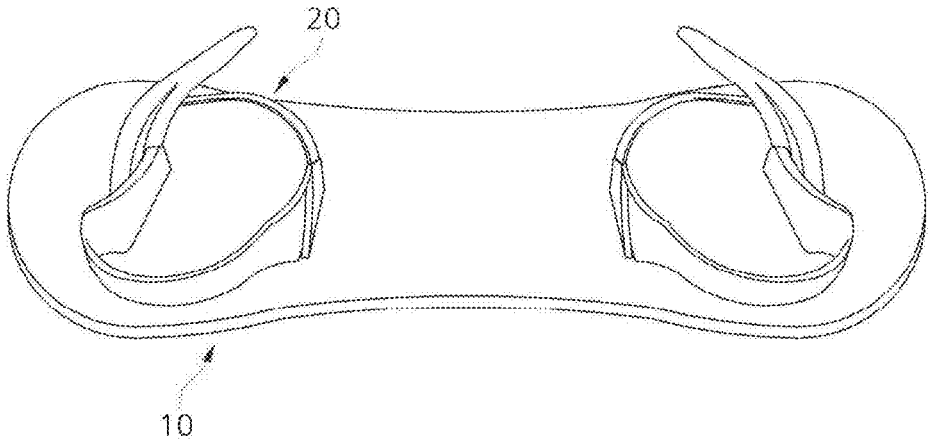
FIG. 1 is a view illustrating a configuration of a snowboard deck with a conventional binder installed.
Figure 2:
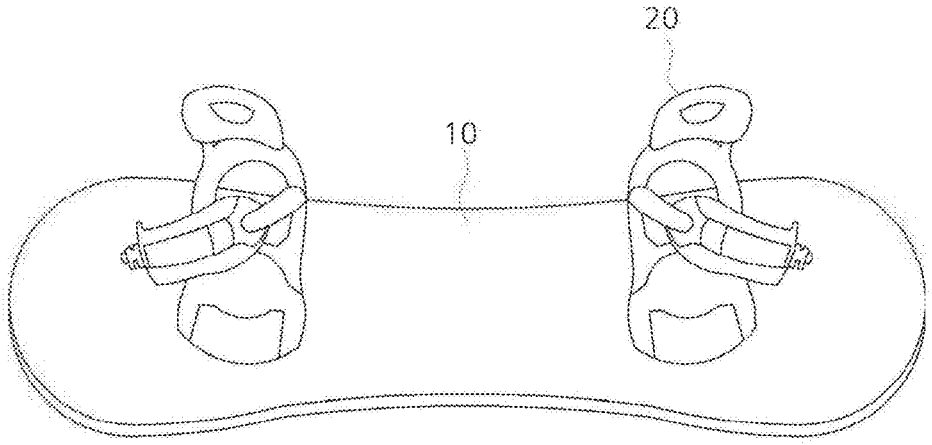
FIG. 2 is a view illustrating a configuration of a snowboard deck with a conventional binder of another example installed.
Figure 3:
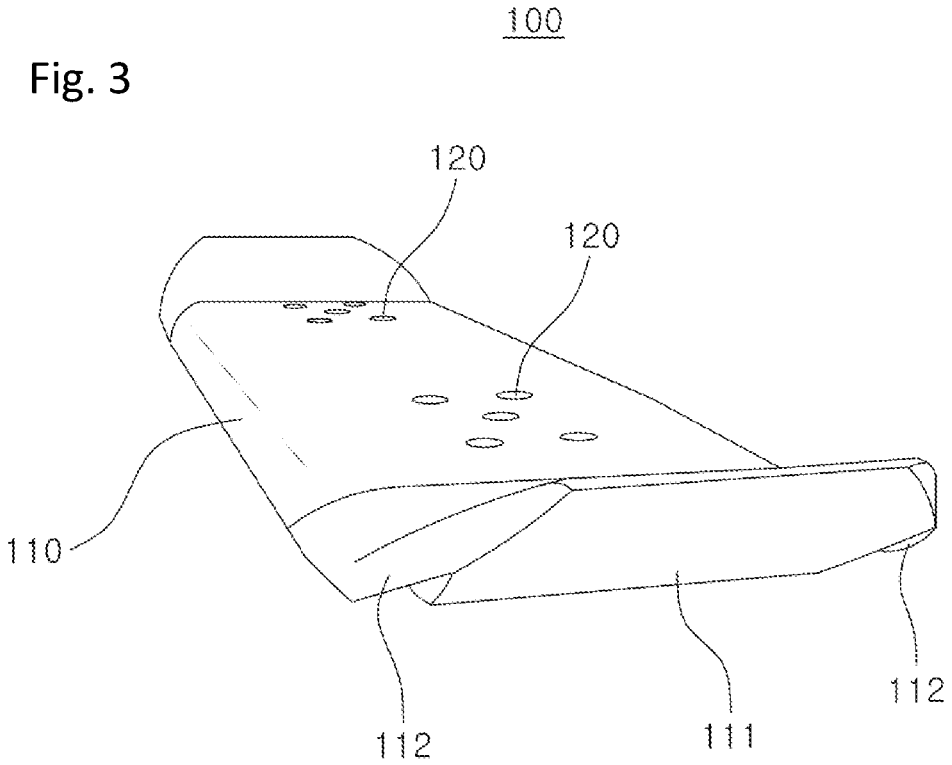
FIG. 3 is a perspective view schematically illustrating a snowboard deck according to an embodiment of the present disclosure.
Figure 4:
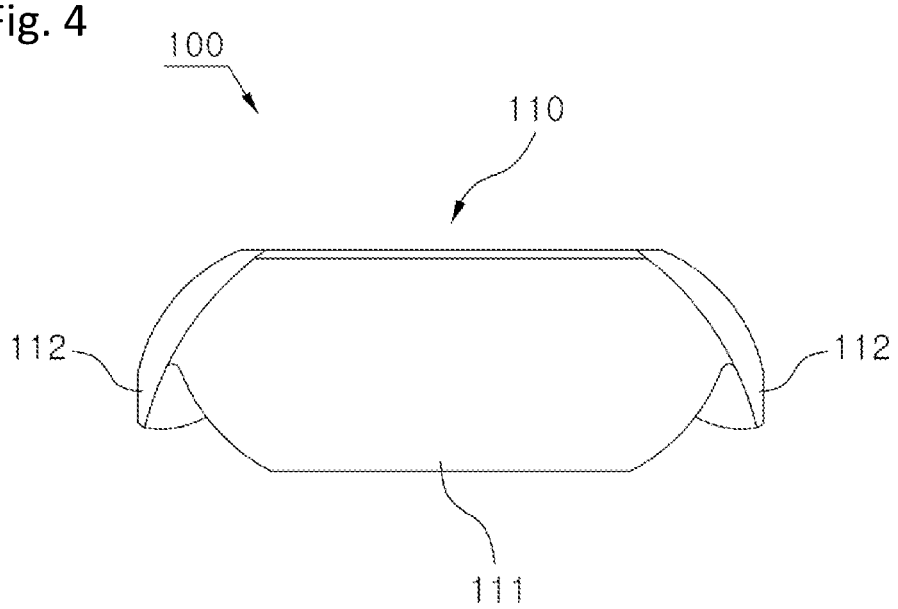
FIG. 4 is a front view schematically illustrating a snowboard deck according to an embodiment of the present disclosure.
Figure 5:
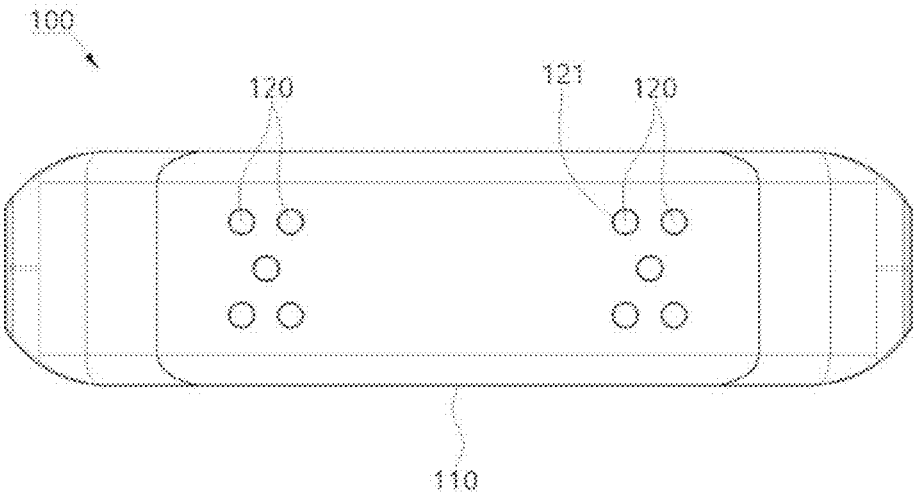
FIG. 5 is a plan view schematically illustrating a snowboard deck according to an embodiment of the present disclosure.

FIG. 3 is a perspective view schematically illustrating a snowboard deck according to an embodiment of the present disclosure, FIG. 4 is a front view schematically illustrating a snowboard deck according to an embodiment of the present disclosure, and FIG. 5 is a plan view schematically illustrating a snowboard deck according to an embodiment of the present disclosure. As illustrated in FIGS. 3 to 5, a snowboard deck 100 according to an embodiment of the present disclosure may include a board-shaped deck body 110 on which both boots 130 worn by a snowboard user desiring to enjoy riding in a snowfield are positioned and fixed, a binder hole 120 formed in a hole shape in the deck body 110 and provided with a magnet 121 to fasten and fix the boots 130 worn by the snowboard user with a magnetic force, and the boots 130 provided with metal protrusions connected through the magnetic force from the magnet 121 inserted and fastened into the binder hole 120. Hereinafter, a configuration of the snowboard deck according to an embodiment of the present disclosure will be described in detail with reference to the accompanying drawings.

Figure 6:
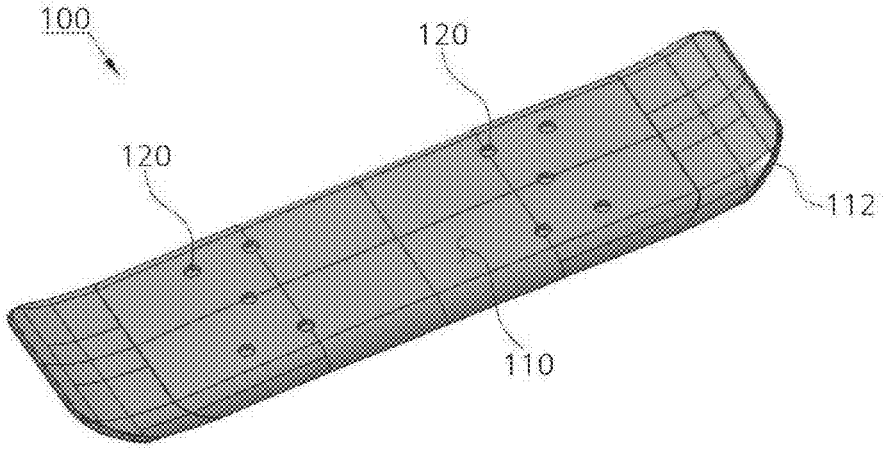
FIG. 6 is a plan perspective view schematically illustrating another example of a snowboard deck according to an embodiment of the present disclosure.
Figure 7:
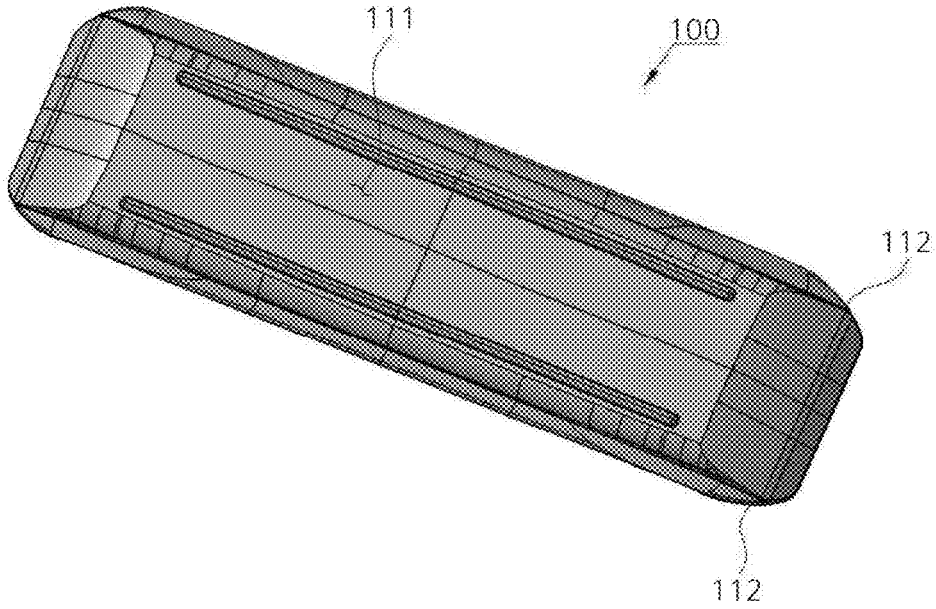
FIG. 7 is a bottom perspective view schematically illustrating another example of a snowboard deck according to an embodiment of the present disclosure.
Figure 8:
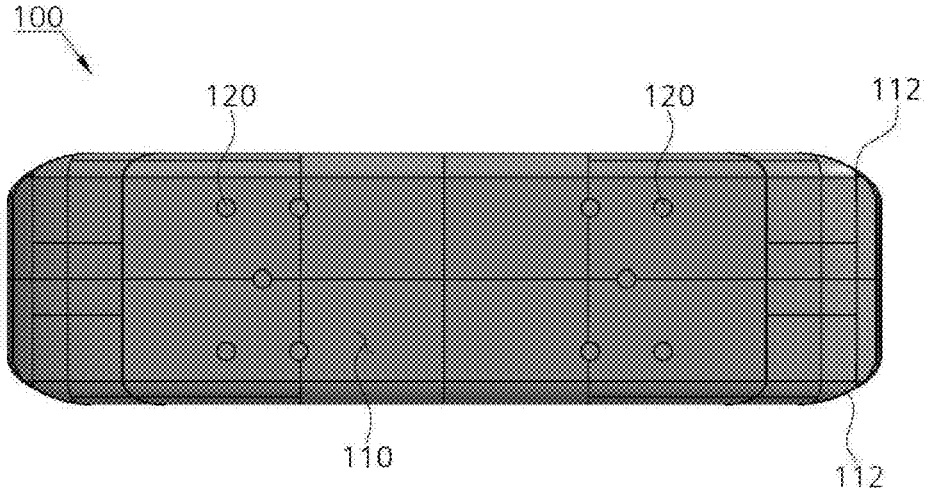
FIG. 8 is a plan view schematically illustrating another example of a snowboard deck according to an embodiment of the present disclosure.
Figure 9:
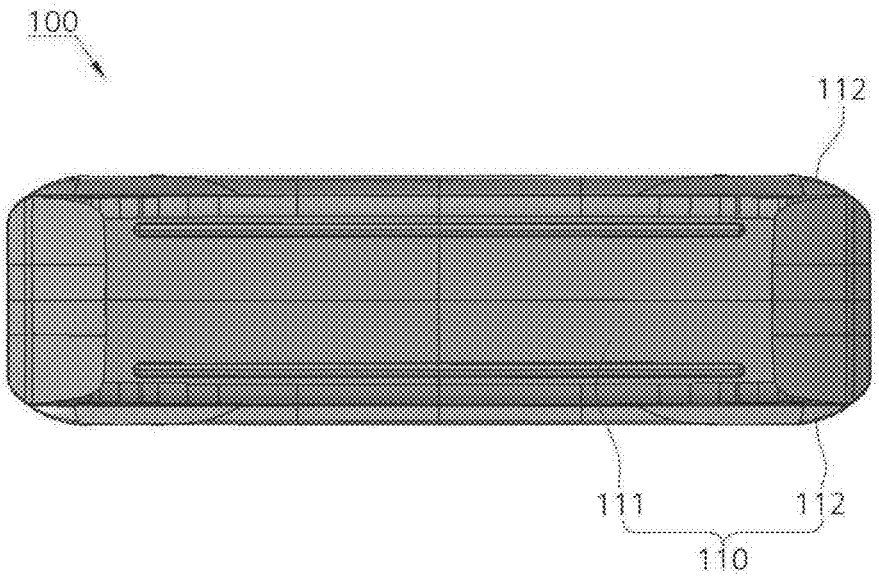
FIG. 9 is a bottom view schematically illustrating another example of a snowboard deck according to an embodiment of the present disclosure.
Figure 10:
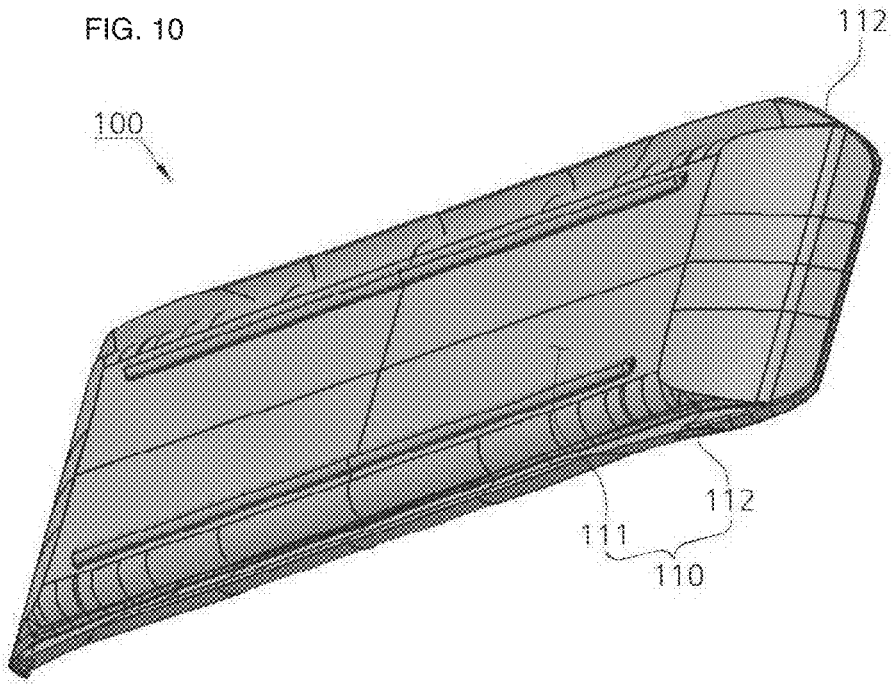
FIG. 10 is a bottom perspective view illustrating another example of a snowboard deck according to an embodiment of the present disclosure.
Figure 11:
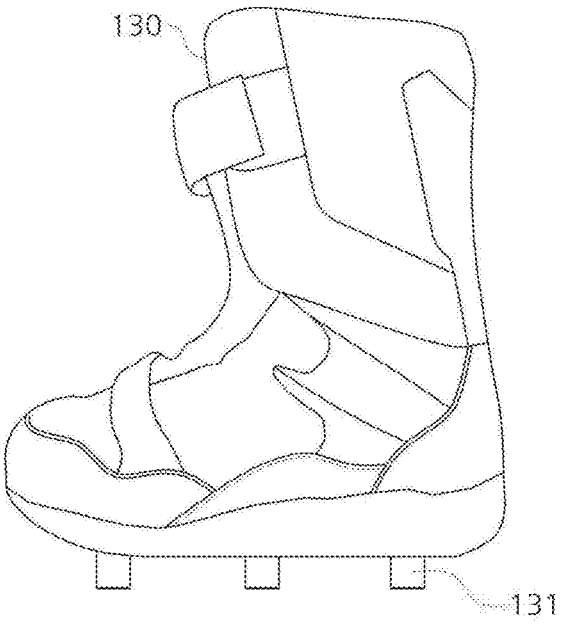
FIG. 11 is a view schematically illustrating a configuration of a boot inserted into a binder hole of a snowboard deck and fastened by a magnetic force according to an embodiment of the present disclosure.
Figure 12:
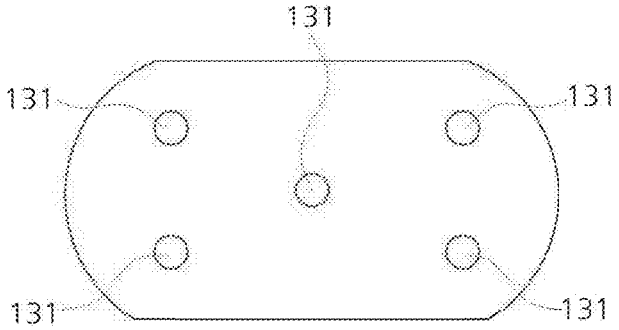
FIG. 12 is a view illustrating a configuration of a bottom surface of a boot inserted into a binder hole of a snowboard deck and fastened by a magnetic force according to an embodiment of the present disclosure.
Figure 13:
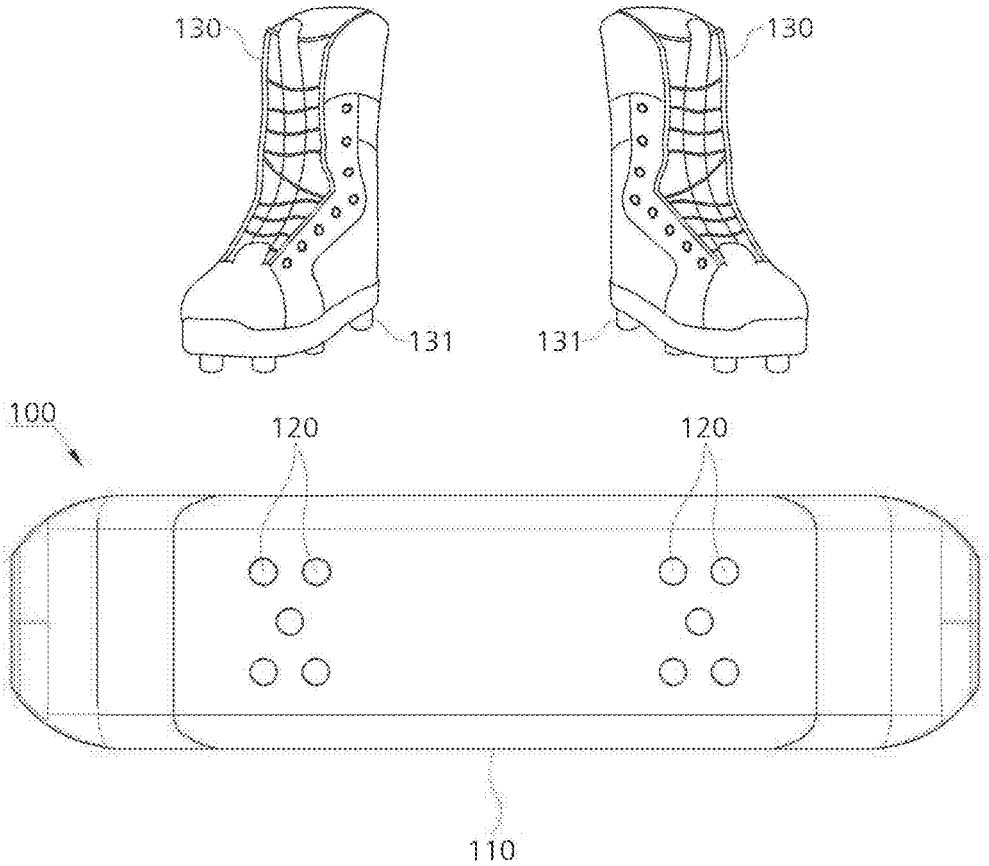
FIG. 13 is an overall perspective view illustrating a deck body, a binder hole, and a boot of a snowboard deck according to an embodiment of the present disclosure.

FIG. 6 is a plan perspective view schematically illustrating another example of a snowboard deck according to an embodiment of the present disclosure, and FIG. 7 is a bottom perspective view schematically illustrating another example of a snowboard deck according to an embodiment of the present disclosure. FIG. 8 is a plan view schematically illustrating another example of a snowboard deck according to an embodiment of the present disclosure, and FIG. 9 is a bottom view schematically illustrating another example of a snowboard deck according to an embodiment of the present disclosure. FIG. 10 is a bottom perspective view illustrating another example of a snowboard deck according to an embodiment of the present disclosure, and FIG. 11 is a view schematically illustrating a configuration of a boot inserted into a binder hole of a snowboard deck and fastened by a magnetic force according to an embodiment of the present disclosure. FIG. 12 is a view illustrating a configuration of a bottom surface of a boot inserted into a binder hole of a snowboard deck and fastened by a magnetic force according to an embodiment of the present disclosure, and FIG. 13 is an overall perspective view illustrating a deck body, a binder hole, and a boot of a snowboard deck according to an embodiment of the present disclosure.

The deck body 110 is a board-shaped member on which both boots 130 worn by a snowboard user desiring to enjoy riding in a snowfield are positioned and fixed. The deck body 110 may include a rounded lower base 111 having a predetermined thickness rather than a thin plate shape, and an edge 112 formed at both sides of the rounded lower base 111 corresponding to a surface that directly contacts the snow. Here, the edge 112 may be configured to protrude while being spaced apart from the body on which the rounded lower base 111 is formed. That is, the edge 112 is elongated on both sides of the deck in the longitudinal direction of the deck.

Also, the edge 112 may be formed to protrude while being spaced apart from the body of the rounded lower base 111 to facilitate direction change and braking of the deck body 110.

In addition, the deck body 110 is provided with a plurality of through holes in which binding holes 120, which will be described later, may be installed. Here, the through holes formed in the deck body 110 allow the binding holes 120 to be installed to correspond to the metal protrusions 131 formed on the boots 130.

The binder hole 120 is formed in a hole shape in the deck body 110 and is provided with the magnet 121 to fasten and fix the binder hole to the boots 130 worn by the snowboard user by magnetic force. The binder hole may include a plurality of binder holes 120 formed in a hole shape in the deck body 110 to be fastened and fixed to the corresponding metal protrusions 131 of the boots 130 worn by the snowboard user by the magnetic force.

In addition, the binder hole 120 may be installed in the deck body 110 such that five binder holes may be disposed per boot 130 to correspond to an arrangement of the metal protrusions 131 of the boot 130, which will be described later. Here, the magnet 123 may include a neodymium magnet that may be firmly fastened to the metal protrusions 131 formed on the boot 130 by the magnetic force. Here, the binder holes 120 are holes formed in the deck itself. The neodymium magnet 121 may be screwed into the holes formed in the deck body 110 and covered with a urethane material.

The boot 130 is a member provided with metal protrusions 131 connected by magnetic force of the magnets 121 inserted and fastened to the binder holes 120. The boot 130 may be provided with metal protrusions 131 connected by magnetic force of the magnets 121 inserted and fastened to the binder holes 120, wherein the metal protrusions 131 may be individually mounted on the boot 130 like spikes or integrally attached to the sole of the boot 130. Here, it may be understood that forming protrusions on the boot 130 is not limited to a specific method and can be implemented in various ways. That is, for example, the protrusions may be attached as a protrusion plate, individually mounted like a golf shoe spike, or integrally attached to the sole of the shoe.

The boots 130 are shoes worn by a snowboard user to enjoy riding in the snowfield, and are configured to be fastened by magnetic force to the binder holes 120 installed in the deck body 110. The boot 130 is provided with a plurality of metal protrusions 131 to be fastened by magnetic force to the binder holes 120 installed in the deck body 110. Here, the boot 130 is provided with five metal protrusions 131 protruding from the bottom thereof such that two set of two metal protrusions 131 are formed at the front and rear sides of the boots 130, respectively, and one metal protrusion 131 is formed in the middle between the front and rear sides.

As such, the snowboard deck 100 includes the board-shaped deck body 110 on which both boots 130 worn by a snowboard user desiring to enjoy riding in a snowfield are positioned and fixed, the binder hole 120 formed in a hole shape in the deck body 110 and provided with the magnet 121 to fasten and fix the boots 130 worn by the snowboard user with a magnetic force, and the boots 130 provided with metal protrusions connected through the magnetic force from the magnet 121 inserted and fastened into the binder hole 120. Accordingly, when the snowboard user falls while riding with the boot 130 fastened and fixed to the binder holes 120 installed in the deck body 110 by magnetic force, the risk of injury caused by failure of separation between the deck and the boots may be minimized. Here, it may be understood that the snowboard deck 100 is also applied to a wakeboard to which a binding function using a deck structure and a magnetic force is applied.

The snowboard deck 100 according to the present disclosure may be manufactured in an injection molding manner because the length of the deck plate is shorter than that of conventional snowboards, and the connection structure of the boots and the binder, the R value and elasticity of the deck edge are more important than the role of the deck board. Such injection manufacturing may reduce manufacturing costs compared to conventional plate-type snowboards manufactured in a resin injection molding (RIM) manner. In addition, by mass production by metal molds, materials may be diversified, and high-strength products may be produced in large quantities at low cost, thereby contributing to the market base expansion.

Existing snowboards require a longer initial learning period, and thus raise the barrier of entry to the sport compared to other sports. However, the board-shaped snowboard according to the present disclosure has an edge end protruding father with a gap formed from the deck body facilitates direction change and braking and allow even beginners to easily enjoy riding, in contrast with the conventional plate-shaped deck and fixed binding structure. Accordingly, it may lead to introduction of a new ski and snowboard population. With the technology according to the present disclosure, conventional hard boots may be changed to soft boots (in terms of aesthetics), and even beginners or children may easily enjoy riding (in terms of convenience). Also, the deck may be easily separated from the boots when the user falls during riding (in terms of safety), and extreme downhill riding (functionality) may be enabled. In addition, just as snowboarding created a new ski resort culture when there were no notable rides other than skiing in the past, the emergence of new rides for beginners may bring expansion of the base of new markets.

A conventional snowboard may be divided into a deck, boots, and a binder. In this regard, applications for boots account for 48% of the total applications, applications for the binder account for 38% and applications for the deck account for 14%. As such, the significantly small number of deck applications compared to the boots and the binder results from the fixed idea that the snowboard is an "integrated plate." In addition, conventional snowboards have limitations in improving braking force because the base and edge are flat, and they require direct tuning the user, which is an inconvenience. In order to address this issue, the present disclosure proposes a board shape having a protruding edge spaced apart from the deck body and facilitating direction change or braking.

In addition, the conventional binder is a structure that fixes the deck and boots to interfere with free footwork during downhill riding. Such a fastening structure of the deck and boots is mainly intended to prevent injury and enable high-speed downhill riding, which have been metallically pointed out as factors that hinder fun and free downhill riding. In order to overcome this issue, the present disclosure proposes a structure in which a hole is formed in a deck to insert a neodymium magnet, and a spike protrusion is formed on the boot so as to be automatically mounted and fixed by magnetic force. Thus, unlike the conventional binder, the deck and the boots may be easily fastened without precise adjustment, and a leash may be attached as in the case of a surfboard to prevent the deck from being separated to a long distance. Thereby, a trendy sensibility element may be provided.

As described above, the snowboard deck according to an embodiment of the present disclosure includes a board-shaped deck body on which both boots worn by a snowboard user desiring to enjoy riding in a snowfield are positioned and fixed, a binder hole formed in a hole shape in the deck body and provided with a magnet to fasten and fix the boots worn by the snowboard user with a magnetic force, and the boots provided with metal protrusions connected through the magnetic force from the magnet inserted and fastened into the binder hole. Accordingly, the boots provided with metal protrusions may be connected by the magnetic force from a neodymium magnet to the binder hole of the deck body having a rounded lower base structure having a predetermined thickness rather than a conventional thin plate shape and configured to directly contact snow, a double-edged edge structure configured to assist together with the rounded lower base structure in changing the direction and braking. In addition, the risk of injury may be minimized by separation of the deck body and the boots when the user falls down during riding. In particular, attachment, detachment and fixing of the boots and the deck may be enabled by the magnetic force in the binder hole. Accordingly, unlike the conventional binder, the boots may be fastened easily without precise adjustment, and even beginners, children, or women may easily attach and fix the boots. Thus, user convenience and efficiency may be further improved. Further, the snowboard deck of the present disclosure may be constructed in a structure in which the length of the deck board is shorter than that of the conventional snowboard, and binding fastening is achieved by magnetic force, and the protruding edge is formed spaced apart from the base of the deck. Accordingly, existing hard boots may be replaced with soft ones, beginners or children may enjoy riding easily. In addition, the shortcomings of the existing snowboard, which often causes injury due to the inability to separate the deck and boots, may be overcome when the user falls during riding, while providing extreme downhill features and easy turning and braking.

As apparent from the above description, the present disclosure provides the following effects.

A snowboard deck proposed in the present disclosure includes a board-shaped deck body on which both feet of a snowboard user desiring to enjoy riding in a snowfield are positioned and fixed, a binder hole formed in the form of a hole in the deck body and provided with a magnet to fasten and fix boots worn by the snowboard user with a magnetic force, and the boots provided with metal protrusions connected through the magnetic force from the magnet inserted and fastened into the binder hole. Accordingly, the boots provided with metal protrusions may be connected by the magnetic force from a neodymium magnet to the binder hole of the deck body having a rounded lower base structure having a predetermined thickness rather than a conventional thin plate shape and configured to directly contact snow, a double-edged edge structure configured to assist together with the rounded lower base structure in changing the direction and braking. In addition, the risk of injury may be minimized by separation of the deck body and the boots when the user falls down during riding.

The snowboard deck of the present disclosure may enable attachment, detachment and fixing of the boots and the deck by the magnetic force in the binder hole. Accordingly, unlike the conventional binder, the boots may be fastened easily without precise adjustment, and even beginners, children, or women may easily attach and fix the boots. Thus, user convenience and efficiency may be further improved.

Further, the snowboard deck of the present disclosure may be constructed in a structure in which the length of the deck board is shorter than that of the conventional snowboard, and binding fastening is achieved by magnetic force, and the protruding edge is formed spaced apart from the base of the deck. Accordingly, existing hard boots may be replaced with soft ones, beginners or children may enjoy riding easily. In addition, the shortcomings of the existing snowboard, which often causes injury due to the inability to separate the deck and boots, may be overcome when the user falls during riding, while providing extreme downhill features and easy turning and braking.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

What is claimed is:

1. A snowboard deck and boot system comprising:

boots worn by snowboarders desiring to enjoy riding in a snowfield for riding in the snow;

a board-shaped deck body on which both boots worn by the snowboarder are positioned and fixed;

a binder hole formed in a hole shape in the deck body and provided with a magnet to fasten and fix the boots with a magnetic force; and wherein the boots comprise:

metal protrusions connected by the magnetic force of the magnet inserted and fastened to the binder holes, wherein the metal protrusions are individually mounted on the boots like spikes or integrally attached to soles of the boots, wherein the deck body comprises:

a continuous rounded lower base having a predetermined thickness; and an edge formed at both sides of the continuous rounded lower base corresponding to a surface that directly contacts the snow, wherein the edge is formed to protrude while being spaced apart from the body of the continuous rounded lower base to facilitate direction change and braking of the deck body, wherein the binder hole comprises:

a plurality of binder holes formed in a hole shape in the deck body to be fastened and fixed to the corresponding metal protrusions of the boots by the magnetic force.

2. The snowboard deck of claim 1, wherein the binder hole is installed in the deck body such that five binder holes are disposed per boot to correspond to an arrangement of the metal protrusions of the boots.

3. The snowboard deck of claim 2, wherein the magnet comprises a neodymium magnet firmly fastened to the metal protrusions formed on the boots by the magnetic force.

4. The snowboard deck of claim 2, wherein the boots are fastened and fixed to the binder hole installed in the deck body by the magnetic force, such that a risk of injury caused by failure of separation between the deck and the boots is minimized when the user falls.

* * * * *